US007283107B2

(12) United States Patent
Chao et al.

(10) Patent No.: US 7,283,107 B2
(45) Date of Patent: Oct. 16, 2007

(54) DRIVING CIRCUIT FOR REDUCING NOISE OF A CERAMIC CAPACITOR

(75) Inventors: Han-Lin Chao, Padeh (TW); Po-Kun Hsieh, Padeh (TW); Chi-Hsiu Lin, Padeh (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 341 days.

(21) Appl. No.: 11/144,701

(22) Filed: Jun. 6, 2005

(65) Prior Publication Data

US 2006/0273991 A1 Dec. 7, 2006

(51) Int. Cl.
*G09G 3/28* (2006.01)

(52) U.S. Cl. ..... 345/68

(58) Field of Classification Search ..... 315/169.1, 315/169.2, 169.3, 169.4; 345/37, 38, 39, 345/32, 204, 206, 41–44, 69–70, 68
See application file for complete search history.

(56) References Cited

U.S. PATENT DOCUMENTS 6,066,860 A * 5/2000 Katayama et al. ..... 257/71
6,618,031 B1 * 9/2003 Bohn et al. ..... 345/83
7,057,680 B2 * 6/2006 Sato ..... 349/94
7,208,718 B2 * 4/2007 Park et al. ..... 250/214 R

* cited by examiner

*Primary Examiner*—Shih-Chao Chen
*Assistant Examiner*—Minh Dieu A
(74) *Attorney, Agent, or Firm*—Birch, Stewart, Kolasch & Birch, LLP

(57) ABSTRACT

A driving circuit for reducing noise of a ceramic capacitor, that is capable of driving a plasma display unit, is provided. The circuit includes a circuit board, a first switch, a second switch, a first capacitor set, a second capacitor set, and a control switch. The first switch is located on the circuit board and coupled to the second switch at a connecting point and the connecting point is connecting to the plasma display. The first capacitor set is coupled to the first switch and provides a first driving voltage to turn on the first switch. The second capacitor set is coupled to the second switch and provides a second driving voltage to turn on the second switch. The control switch can control the first switch and the second switch to carry out a charged and discharged operation. Moreover, the first and second capacitor sets both include an even number of ceramic capacitors subsequently those are located in reverse.

12 Claims, 2 Drawing Sheets

DRIVING CIRCUIT FOR REDUCING NOISE OF A CERAMIC CAPACITOR

BACKGROUND OF THE INVENTION

1. Field of the Invention

This invention relates to a driving circuit for reducing noise of the ceramic capacitors in a plasma display, and more particularly to a driving circuit by changing the amount of the ceramic capacitors and the location thereof to reduce noise of the ceramic capacitors.

2. Description of the Related Art

In recent years, the flat panel display (FPD) has been extensively applied in the electric products such as PDAs (Personal Digital Assistant), mobile phones, and laptops and even the big size display used for the home theaters. The liquid crystal display (LCD) is the mainstream in the FPD market nowadays. However, in the large-size display field, the LCD has limitation with the manufactured process and big size of glass substrate. Therefore, the traditional cathode ray tube (CRT) display still occupies the large-size of display market. However, as the display size of the CRT is getting larger, the weight and the size of CRT are also being increased. Therefore, the plasma display panel (PDP) has advantages with light, thin, and large size, and being expected to become the desired product the large size TV.

AC plasma display panels (PDPs) generate the majority of their emitted light by employed ultraviolet light discharged from plasma generated by a gas discharge driven by high-frequency high-voltage electrode movement to excite visible light emitting phosphors. Hence, in the driving circuits of PDP, ceramic capacitors are largely used for providing the driving voltage for the driving circuit. As shown in the FIG. 1, which is a diagram showing a conventional driving circuit. The driving circuit comprises an even number of parallel-connected ceramic capacitors C for storing driving voltage to sustain the PDP 30. However, the driving circuit of the PDP 30 often needs to carry out the actions of charged and discharged more than 200 KHz in frequency such that the ceramic capacitors also have to operate at the same high frequency. Thus, noise will be induced by the mechanical vibrations of the ceramic capacitors that are caused by the high-frequency charged and discharged operations of the capacitors. In addition, the more ceramic capacitors are used, the more obvious noise is induced. The present invention provides a novel driving circuit capable of reducing noise of the ceramic capacitor for resolving the aforesaid problems.

SUMMARY OF THE INVENTION

It is the primary object of the present invention to provide a driving circuit for reducing noise of a ceramic capacitor, which comprises an even number of ceramic capacitors disposed in reverse sequentially so as to reduce the noise.

According to an embodiment of the present invention, a driving circuit for reducing noise of a ceramic capacitor and driving a plasma display, the driving circuit comprises a circuit board, a first switch, a second switch, a first capacitor set, a second capacitor set, and a control switch. The first switch is located on the circuit board and coupled to the second switch at a connecting point. The connecting point is connecting to the plasma display. The first capacitor set is coupled to the first switch and provides a first driving voltage to turn on the first switch. The second capacitor set is coupled to the second switch and provides a second driving voltage turn on the second switch. The control switch controls the first switch and the second switch to carry out a charged and discharged operation. Moreover, the first and the second capacitor sets both comprise an even number of ceramic capacitors subsequently disposed in reverse.

DETAILED DESCRIPTION OF THE INVENTION

Matched with corresponding drawings, the preferable embodiments of the invention are presented as following and hope they will benefit your esteemed reviewing committee members in reviewing this patent application favorably.

Figure 1:
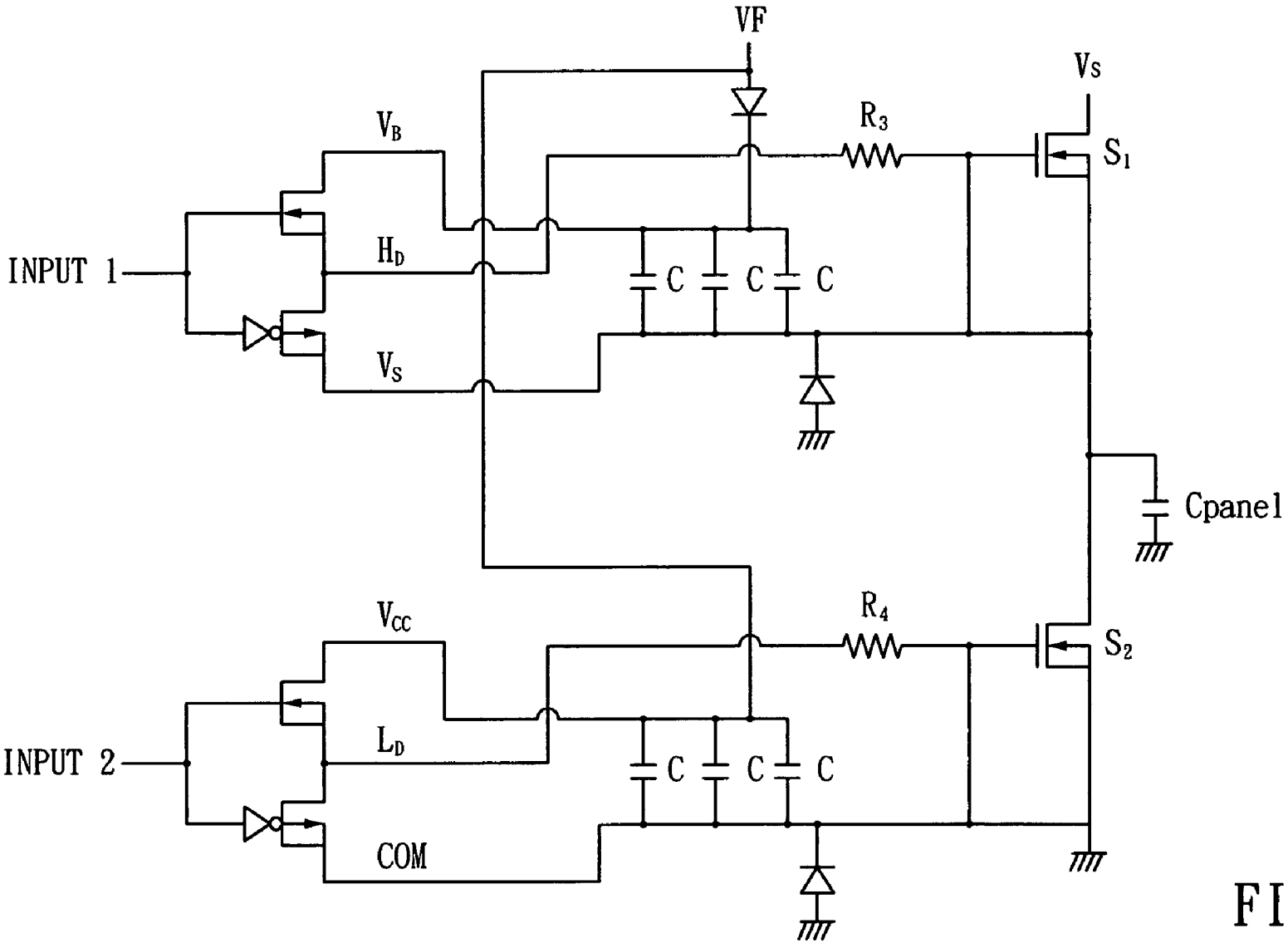
FIG. 1 is a schematic view showing a conventional driving circuit.
Figure 2:
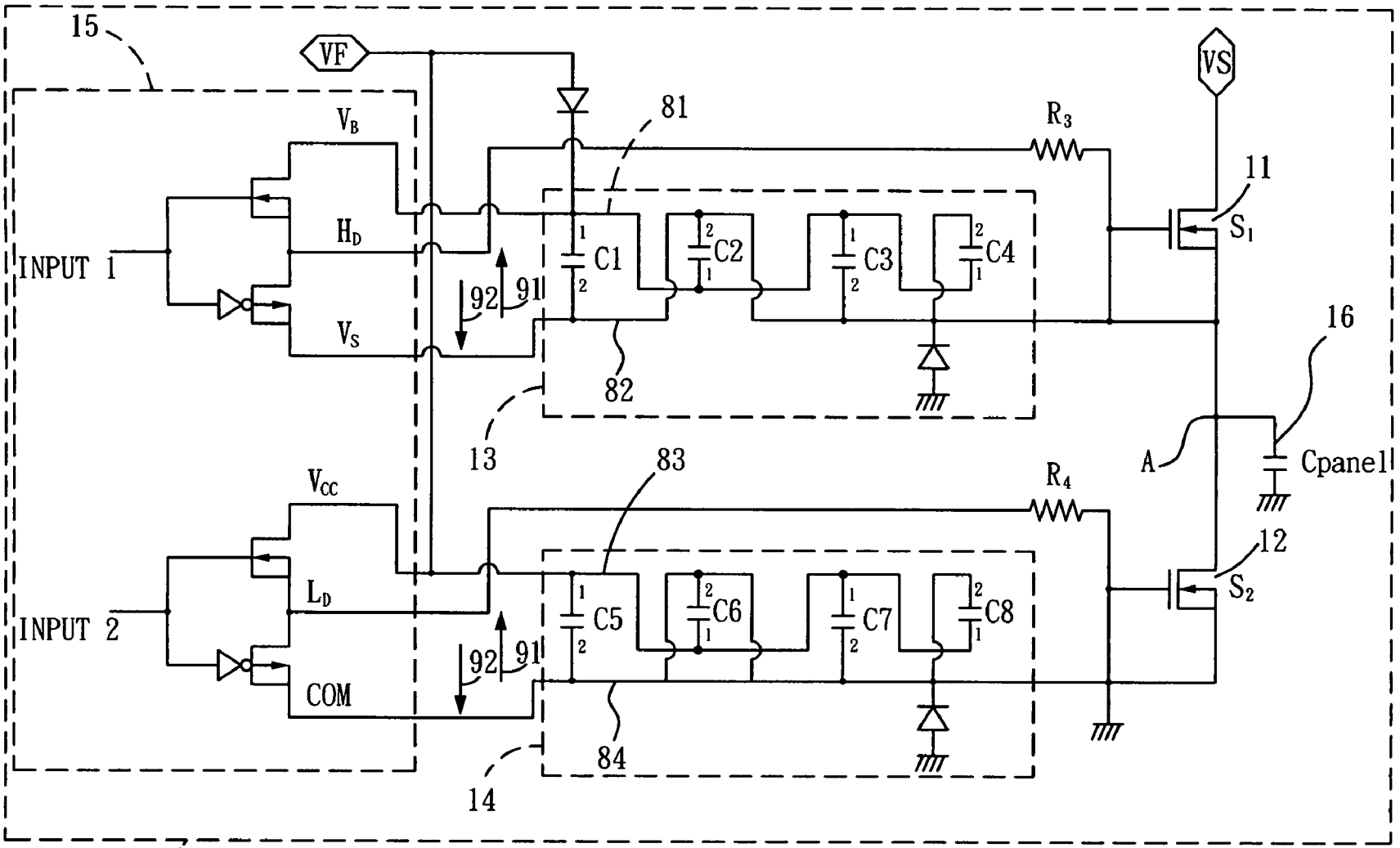
FIG. 2 is a schematic view showing a driving circuit for reducing noise of a ceramic capacitor according to the present invention.

As shown in FIG. 2, the driving circuit for reducing noise of a ceramic capacitor according to the present invention is provided. The driving circuit comprises a circuit board 10, a first switch 11, a second switch 12, a first capacitor set 13, a second capacitor set 14, and a control switch 15. The first switch 11 is located on the circuit board 10 and coupled to the second switch 12 at the point A that is coupled to the plasma display 16. The first and the second switches are both MOS switches that respectively provide the first and the second driving voltage to turn on the first switch 11 and the second switch 12 through the corresponding first capacitor set 13 and second capacitor set 14. The first capacitor set 13 has the first driving voltage and is coupled to the first switch 11. The second capacitor set 14 has the second driving voltage and is coupled to the second switch 12. The control switch 15 is coupled to the first capacitor set 13 and the second capacitor set 14 so as to respectively control the first capacitor set 13 and the second capacitor set 14 to carry out the charge and discharge. The control switch 15 has a third switch 151, a fourth switch 152, a first NOT gate 153, a fifth switch 154, a sixth switch 156, and a second NOT gate 157. The third switch 151 and the fourth switch 152 are coupled to each other and connected to the first capacitor set 13 to carry out charge and discharge, and the first NOT gate 153 is coupled to the fourth switch 152. The fifth switch 154 and the sixth switch 156 are coupled to each other and connected to the second capacitor set 14 to carry out charge and discharge, and the second NOT gate 157 is coupled to the sixth switch 156. In addition, VS and VF can be employed as the power supply for the driving circuit.

In the preferred embodiment of the present invention, the first capacitor set 13 includes an even number of ceramic capacitors that are the first ceramic capacitor C1, the second ceramic capacitor C2, the third ceramic capacitor C3, and the fourth ceramic capacitor C4 connected each other in parallel. The capacitance of the first capacitor set is exactly equal to the sum of the capacitances of the first ceramic capacitor C1, the second ceramic capacitor C2, the third ceramic capacitor C3, and the fourth ceramic capacitor C4. Although there are only four ceramic capacitors showing in the figure, it should be not limited in the four, and the amount of the ceramic capacitor is determined basing on the capacitance required by the circuit. The first, the second, the third, and the fourth ceramic capacitors C1, C2, C3, C4 all have a first terminal 1 and a second terminal 2, and are located in reverse sequentially. In other words, the first terminal 1 of the second ceramic capacitor C2 is located opposite to that of the first ceramic capacitor C1, and the first terminal 1 of the fourth ceramic capacitor C4 is located opposite to that of the third capacitor C3. In addition, a first running wire 81 is provided to connect all the first terminals of the first, the second, the third, and the fourth ceramic capacitors (C1, C2, C3, C4), and a second running wire 82 is provided to connect all the second terminals of ceramic capacitors C1, C2, C3, and C4 thus forming the first capacitor set 13 having the first, the second, the third, and the fourth ceramic capacitors located in reverse sequentially.

When turning on the first switch 11, the first, the second, the third, and the fourth ceramic capacitors (C1, C2, C3, C4) can provide the first driving voltage during a discharged period so as to electrify an interface capacitor (not shown in the figure) of the first switch 11 thus making the interface capacitor of the first switch 11 accumulate sufficient voltage to turn on the first switch 11. At this time, the electric current direction of C1 is the first direction 91 so that the electric current direction of C2 will be the second direction 92, and the electric current direction of C3 is the first direction 91 so that the electric current direction of C4 will be the second direction 92. Moreover, the located mode of these ceramic capacitors can neutralize the mechanical vibration due to the discharging of the ceramic C1, C2, C3, and C4. When the control switch 15 electrifying the first, the second, the third, and the fourth ceramic capacitor, the electric current direction of C1 will be the second direction 92 so that the electric current direction of C2 will be the first direction 91, and electric current direction of C3 will be the second direction 92 so that electric current direction of C4 will be the first direction 91. And also the mechanical vibration due to the electrifying of the ceramic C1, C2, C3, and C4 can be neutralized.

In addition, the second capacitor set 14 includes an even number of ceramic capacitors that are the fifth ceramic capacitor C5, the sixth ceramic capacitor C6, the seventh ceramic capacitor C7, and the eighth ceramic capacitor C8 connected each other in parallel. The capacitance of the second capacitor set is exactly equal to the sum of the capacitances of the fifth ceramic capacitor C5, the sixth ceramic capacitor C6, the seventh ceramic capacitor C7, and the eighth ceramic capacitor C8. The fifth, the sixth, the seventh, and the eighth ceramic capacitors C5, C6, C7, C8 all have a first terminal 1 and a second terminal 2, and are located in reverse sequentially. In other words, the first terminal 1 of the sixth ceramic capacitor C6 is located opposite to that of the fifth ceramic capacitor C5, the first terminal 1 of the seventh ceramic capacitor C7 is located opposite to that of the sixth ceramic capacitor C6, and the first terminal 1 of the eighth ceramic capacitor C8 is located opposite to that of the seventh capacitor C7. In addition, a third running wire 83 is provided to connect all the first terminals of the fifth, the sixth, the seventh, and the eighth ceramic capacitors (C5, C6, C7, C8), and a fourth running wire 84 is provided to connect all the second terminals of ceramic capacitors C5, C6, C7, and C8 thus forming the second capacitor set 14 having the fifth, the sixth, the seventh, and the eighth ceramic capacitors located in reverse sequentially.

When turning on the second switch 12, the fifth, the sixth, the seventh, and the eighth ceramic capacitors (C5, C6, C7, C8) can provide the second driving voltage during a discharged period so as to electrify an interface capacitor (not shown in the figure) of the second switch 12 thus making the interface capacitor of the second switch 12 accumulate sufficient voltage to turn on the second switch 12. At this time, the electric current direction of C5 is the first direction 91 so that the electric current direction of C6 will be the second direction 92, and the electric current direction of C7 is the first direction 91 so that the electric current direction of C8 will be the second direction 92. In the second capacitor set 14, the located mode of these ceramic capacitors can neutralize each other the mechanical vibration due to the discharging of the ceramic C5, C6, C7, and C8. When the control switch 15 electrifying the fifth, the sixth, the seventh, and the eighth ceramic capacitor, the electric current direction of C5 will be the second direction 92 so that the electric current direction of C6 will be the first direction 91, and electric current direction of C7 will be the second direction 92 so that electric current direction of C8 will be the first direction 91. And also the mechanical vibration due to the electrifying of the ceramic C1, C2, C3, and C4 can be neutralized each other. The noise and mechanical vibration due to high-frequency charged and discharged operations of the ceramic capacitors can be eliminated by the above mentioned circuit.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A driving circuit for reducing noise of a ceramic capacitor, being used to drive a plasma display unit, comprising:

a circuit board;

a first switch located on said circuit board;

a second switch coupled to said first switch and said plasma display unit at a connecting point;

a first capacitor set comprising an even number of ceramic capacitors subsequently disposed in reverse, said first capacitor set being coupled to said first switch and said first switch being turned on by a first driving voltage;

a second capacitor set comprising an even number of ceramic capacitors subsequently disposed in reverse, said second capacitor set being coupled to said second switch and said second switch being turned on by a second driving voltage; and a control switch coupled to said first and second capacitor sets controlling said first and second capacitor sets to carry out a charged and discharged operation.

2. The driving circuit according to claim 1, wherein each of said ceramic capacitors has a first terminal, and all said first terminals are connected together by a wire.

3. The driving circuit according to claim 1, wherein the charging directions of the first ceramic capacitor and the second ceramic capacitor are opposite during the same charging period.

4. The driving circuit according to claim 3, wherein said discharged direction of said first ceramic capacitor and said second ceramic capacitor are opposite during the same discharged period.

5. The driving circuit according to claim 1, wherein said first switch and said second switch are MOS transistors.

6. The driving circuit according to claim 1, wherein said control switch comprises a third switch, a fourth switch coupled to said third switch, a first NOT gate coupled to said fourth switch, a fifth switch, a sixth switch coupled to said fifth switch, and a second NOT gate coupled to said sixth switch.

7. The driving circuit according to claim 6, wherein said third switch, fourth switch, fifth switch, and sixth switch are MOS transistors.

8. A driving circuit for reducing noise of a ceramic capacitor, being used to drive a plasma display, comprising:

a first switch;

a second switch coupled to said first switch at a connecting point and said connecting point connected to said display panel;

a first capacitor set coupled to said first switch and said first switch being turned on by a first driving voltage;

a second capacitor set coupled to said second switch and said second switch being turned on by a second driving voltage;

a control switch coupled to said first and second capacitor sets controlling said first and second capacitor sets to carry out a charged and discharged operation;

wherein said first capacitor set and said second capacitor set both has an even number of ceramic capacitors subsequently disposed in reverse, and each of said ceramic capacitors has a first terminal, connected to each other with a wire.

9. The driving circuit according to claim 8, wherein said even number of ceramic capacitors comprises a first ceramic capacitor, a second ceramic capacitor, a third ceramic capacitor, and a fourth ceramic capacitor, said first terminal of said second ceramic capacitor is opposite to said first ceramic capacitor, and said first terminal of said third ceramic capacitor is opposite to said second ceramic capacitor, and said first terminal of said fourth ceramic capacitor is opposite to the third capacitor.

10. The driving circuit according to claim 9, wherein the charged direction of said first ceramic capacitor and said second ceramic capacitor are opposite during the same charged period.

11. The driving circuit according to claim 8, wherein said first switch and said second switch are both MOS transistors.

12. The driving circuit according to claim 10, wherein said discharged direction of said first ceramic capacitor and said second ceramic capacitor are opposite during the same discharged period.

* * * * *